US007619592B2

(12) United States Patent
Chang et al.

(10) Patent No.: US 7,619,592 B2
(45) Date of Patent: Nov. 17, 2009

(54) DRIVING METHOD OF PLASMA DISPLAY PANEL

(75) Inventors: Seung-Woo Chang, Suwon-si (KR); Woo-Jin Kim, Suwon-si (KR); Chee-Young Yoon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 575 days.

(21) Appl. No.: 11/269,587

(22) Filed: Nov. 9, 2005

(65) Prior Publication Data

US 2006/0103600 A1 May 18, 2006

(30) Foreign Application Priority Data

Nov. 12, 2004 (KR) ..... 10-2004-0092357

(51) Int. Cl.
*G09G 3/28* (2006.01)

(52) U.S. Cl. ..... 345/68; 345/60; 345/67

(58) Field of Classification Search ..... 345/60–72; 315/169.4

See application file for complete search history.

(56) References Cited

U.S. PATENT DOCUMENTS 6,011,355 A 1/2000 Nagai
6,329,751 B2 12/2001 Yoo
6,414,653 B1 7/2002 Kobayashi
6,853,358 B2 2/2005 Kunii et al.
6,922,191 B2 7/2005 Watanabe
6,954,188 B2 10/2005 Seo et al.
7,023,406 B1 4/2006 Nonomura et al.
7,050,022 B2 5/2006 Kigo et al.
7,133,008 B2 11/2006 Naganuma
7,145,582 B2 12/2006 Shindo et al.
7,173,578 B2 * 2/2007 Kim et al. ..... 345/60

(Continued)

FOREIGN PATENT DOCUMENTS

CN 1 438 619 A 8/2003

(Continued)

OTHER PUBLICATIONS

Chung-Hoo Park, Dong-Hyn Kim, Sung-Hyn Lee, Jae-Hwa Ryu, Jung-Soo Choo A New Method to Reduce Addressing Time in a Large AC Plasma Display Panel Jun. 2001 IEEE Transactions on Electron Devices, vol. 48, No. 6.*

(Continued)

*Primary Examiner*—David L Lewis
(74) *Attorney, Agent, or Firm*—Lee & Morse, P.C.

(57) ABSTRACT

A driving method of a plasma display panel in which scan electrode lines and sustain electrode lines are parallel to each other and address electrode lines are spaced from and intersect the scan electrode lines and the sustain electrode lines, includes temporally dividing a unit frame into a plurality of subfields, generating a driving signal having a reset period, an address period, and a sustain period for each subfield, detecting an average signal level for the unit frame, alternately applying a first sustain pulse which reaches a first voltage with a rising slope and a second sustain pulse which reaches a ground voltage with a falling slope to the scan electrode lines and the sustain electrode lines, and controlling a timing of alternately applying in accordance with the average signal level for the unit frame.

20 Claims, 8 Drawing Sheets

U.S. PATENT DOCUMENTS

| | | | | |
|---|---|---|---|---|
| 7,250,925 | B2 * | 7/2007 | Seo et al. | 345/66 |
| 7,348,939 | B2 * | 3/2008 | Lee et al. | 345/60 |
| 7,352,341 | B2 * | 4/2008 | Chae et al. | 345/60 |
| 7,375,703 | B2 | 5/2008 | Jeong et al. | |
| 7,391,390 | B2 * | 6/2008 | Son | 345/60 |
| 7,423,616 | B2 | 9/2008 | Ogawa et al. | |
| 2003/0234753 | A1 | 12/2003 | Tanaka | |
| 2004/0164930 | A1 * | 8/2004 | Hashimoto et al. | 345/60 |
| 2007/0171149 | A1 * | 7/2007 | Hashimoto et al. | 345/60 |

FOREIGN PATENT DOCUMENTS

| | | | |
|---|---|---|---|
| CN | 1 504 983 | A | 6/2004 |
| EP | 1 274 064 | | 1/2003 |
| JP | 11-015436 | | 1/1999 |
| JP | 11-120924 | | 4/1999 |
| JP | 2000-322025 | | 11/2000 |
| JP | 2001-184024 | | 7/2001 |
| JP | 2002-132206 | | 5/2002 |
| JP | 2002-207449 | | 7/2002 |
| JP | 2003-005705 | A | 1/2003 |
| JP | 2003-015590 | | 1/2003 |
| JP | 2003-050563 | | 2/2003 |
| JP | 2003-058104 | | 2/2003 |
| JP | 2004-151348 | | 5/2004 |
| JP | 2004-177980 | | 6/2004 |
| JP | 2004-206093 | | 7/2004 |
| JP | 2005-017346 | A | 1/2005 |

OTHER PUBLICATIONS

Jung, Y.K., et al., "Circuit Model for Two-Electrode AC Discharge", IEEE Transactions on Plasma Science, vol. 31, No. 3, pp. 362-368, (Jun. 2003).

Seo, J.W., et al., "Twin voltage-ramp reset for high speed addressing of three-electrode AC plasma display panel", Displays, vol. 25, No. 2-3, pp. 49-56 (Aug. 2004).

* cited by examiner

DRIVING METHOD OF PLASMA DISPLAY PANEL

BACKGROUND OF THE INVENTION

1. Field of the Invention

The present invention relates to a driving method of a plasma display panel. More particularly, the present invention relates to a driving method of a plasma display panel that can improve discharge efficiency, extend panel lifetime, and reduce an operating temperature by detecting an average signal level and applying overlapping sustain pulses or non-overlapping sustain pulses depending upon the average signal level during a sustain period.

2. Description of the Related Art

A conventional plasma display panel includes address electrode lines, front and rear dielectric layers, scan electrode lines, sustain electrode lines, fluorescent layers, barrier ribs, and a magnesium monoxide (MgO) protective layer between a front substrate and a rear substrate.

The address electrode lines are formed in a predetermined pattern on the rear substrate. The rear dielectric layer is formed on the address electrode lines. The barrier ribs are formed on the rear dielectric layer in a direction parallel to the address electrode lines. The barrier ribs define a discharge space of each discharge cell and prevent optical interference between the discharge cells. The fluorescent layers are formed on the rear dielectric layer on the address electrode lines between the barrier ribs. The fluorescent layers include red fluorescent layers, green fluorescent layers, and blue fluorescent layers, which are sequentially disposed.

The sustain electrode lines and the scan electrode lines are formed in a predetermined pattern on the front substrate to intersect the address electrode lines. The respective intersections define the corresponding display cells. The respective sustain electrode lines and the respective scan electrode lines can have a transparent electrode line made of a transparent conductive material, e.g., ITO (Indium Tin Oxide), and a metal electrode, i.e., a bus electrode, line for enhancing conductivity. The front dielectric layer is formed to cover the sustain electrode lines and the scan electrode lines. The protective layer for protecting the panel from strong electric fields is formed on the whole front dielectric layer. A gas for forming plasma is enclosed in the discharge spaces.

In order to drive the conventional plasma display panel, one subfield includes a reset period, an address period and a sustain period, and driving signals are applied to the address electrode lines, the sustain electrode lines, and the scan electrode lines.

First, during the reset period, a reset pulse is applied to all of the scan electrode lines and reset discharge is performed, thereby initializing wall charges in all the discharge cells.

Next, during the address period, in order to select cells, scanning pulses are sequentially applied to the scan electrode lines and display data signals are applied to the address electrode lines of the cells to be selected.

Next, during the sustain period, in order to allow the cells selected during the address period to perform sustain discharge, sustain pulses are alternately applied to the sustain electrode lines and the scan electrode lines.

However, the sustain pulses having a sustain discharge voltage applied to the scan electrode lines and the sustain electrode lines during the sustain period do not temporally overlap. In other words, non-overlapping sustain pulses are applied thereto. As a result, the frequency of the sustain discharge successively occurring decreases, resulting in an increased sustain period or a decreased discharge efficiency.

SUMMARY OF THE INVENTION

The present invention is therefore directed to a method of driving a plasma panel display, which substantially overcomes one or more of the problems due to the limitations and disadvantages of the related art.

It is a feature of an embodiment of the present invention to provide a driving method of a plasma display panel that improves discharge efficiency.

It is another feature of an embodiment of the present invention to provide a driving method of a plasma display panel that extends the lifetime of the panel.

It is still another feature of an embodiment of the present invention to provide a driving method of a plasma display panel that lowers an operating temperature of the panel.

It is yet another feature of an embodiment of the present invention to detect an average signal level and apply overlapping sustain pulses or non-overlapping sustain pulses depending upon the average signal level during a sustain period.

At least one of the above and other features and advantages of the present invention may be realized by providing a driving method of a plasma display panel in which scan electrode lines and sustain electrode lines are parallel to each other and address electrode lines are spaced from and intersect the scan electrode lines and the sustain electrode lines, the method including temporally dividing a unit frame into a plurality of subfields, generating a driving signal having a reset period, an address period, and a sustain period for each subfield, detecting an average signal level for the unit frame, alternately applying a first sustain pulse which reaches a first voltage with a rising slope and a second sustain pulse which reaches a ground voltage with a falling slope to the scan electrode lines and the sustain electrode lines, and controlling a timing of alternately applying in accordance with the average signal level for the unit frame.

When the average signal level is less than a predetermined value, controlling the timing may include having the first voltage in the first sustain pulse and in the second sustain pulse simultaneously. Controlling the timing may include applying the second sustain pulse to one of the scan and sustain electrode lines when the first voltage is reached in the other of the scan and sustain electrode lines. When the average signal level is equal to or more than the predetermined value, controlling the timing may include having the first voltage in the first sustain pulse and in the second sustain pulse distinctly.

The driving method may include, during the reset period, applying a sustain discharge voltage to the scan electrode lines, applying a rising voltage to the scan electrode lines, applying a falling ramp signal to the scan electrode lines to reach a lowest falling voltage, and applying a bias voltage to the sustain electrode lines during applying the falling ramp signal.

Applying the falling ramp signal may include abruptly falling to the sustain discharge voltage and then gradually falling from the sustain discharge voltage to the lowest falling voltage. The gradually falling may be delayed after the abruptly falling.

Applying the sustain discharge voltage may include abruptly applying the sustain discharge voltage to the scan electrode lines and applying the rising voltage may include gradually applying the rising voltage to the scan electrode lines. The gradually applying the rising voltage may be delayed after abruptly applying the sustain discharge voltage.

The driving method may include, during the address period sequentially applying a scan high voltage to the scan electrode lines and then applying a scan low voltage, and applying an address voltage to the address electrode lines of selected cells. The bias voltage may be applied to the sustain electrode lines during the address period. The scan low voltage may equal the lowest falling voltage.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
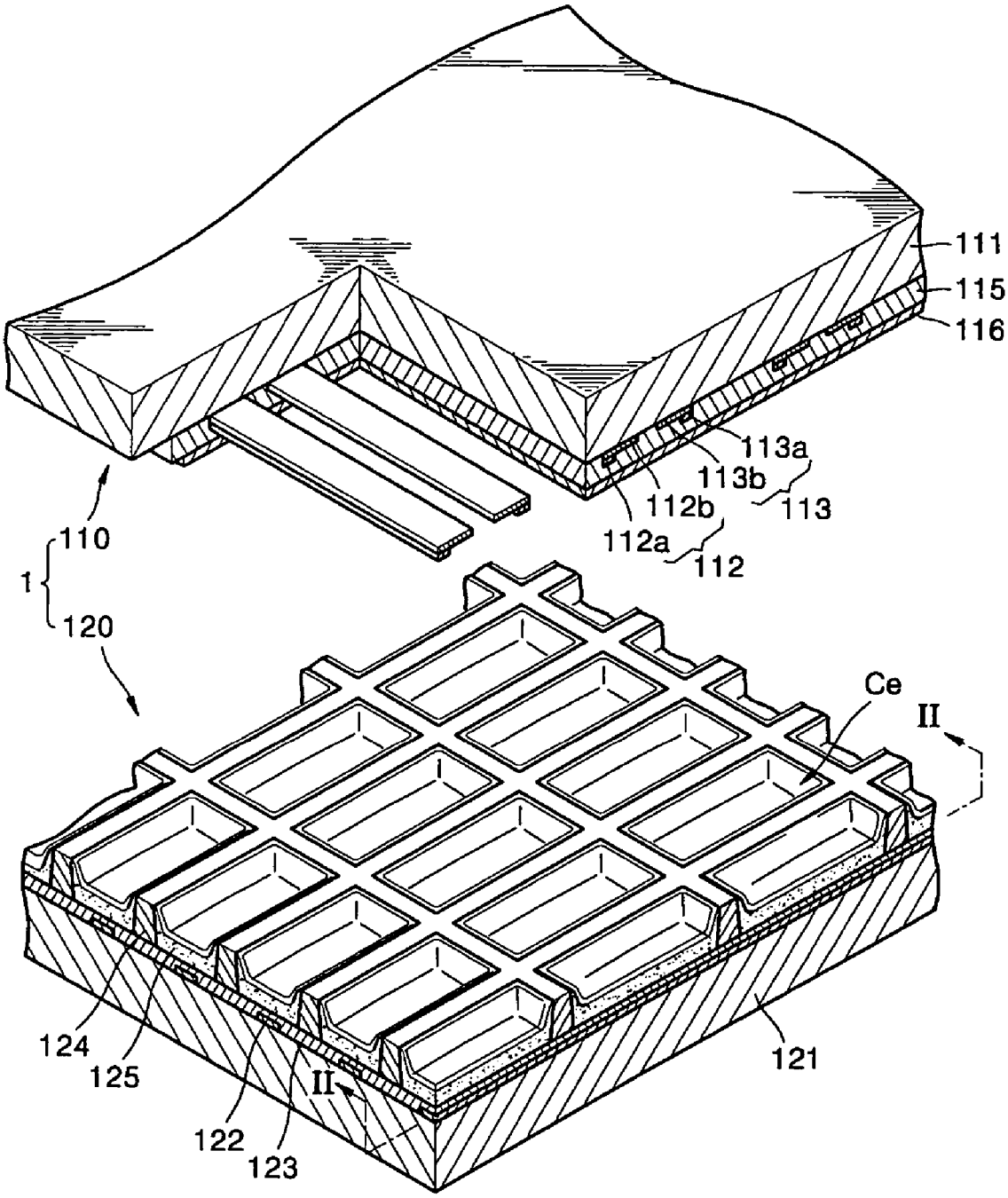
FIG. 1 illustrates an exploded perspective view of a plasma display panel to which a driving method according to the present invention is applied.

Korean Patent Application No. 10-2004-0092357, filed on Nov. 12, 2004, in the Korean Intellectual Property Office, and entitled "Driving Method of Plasma Display Panel," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. Like reference numerals refer to like elements throughout.

Figure 2:
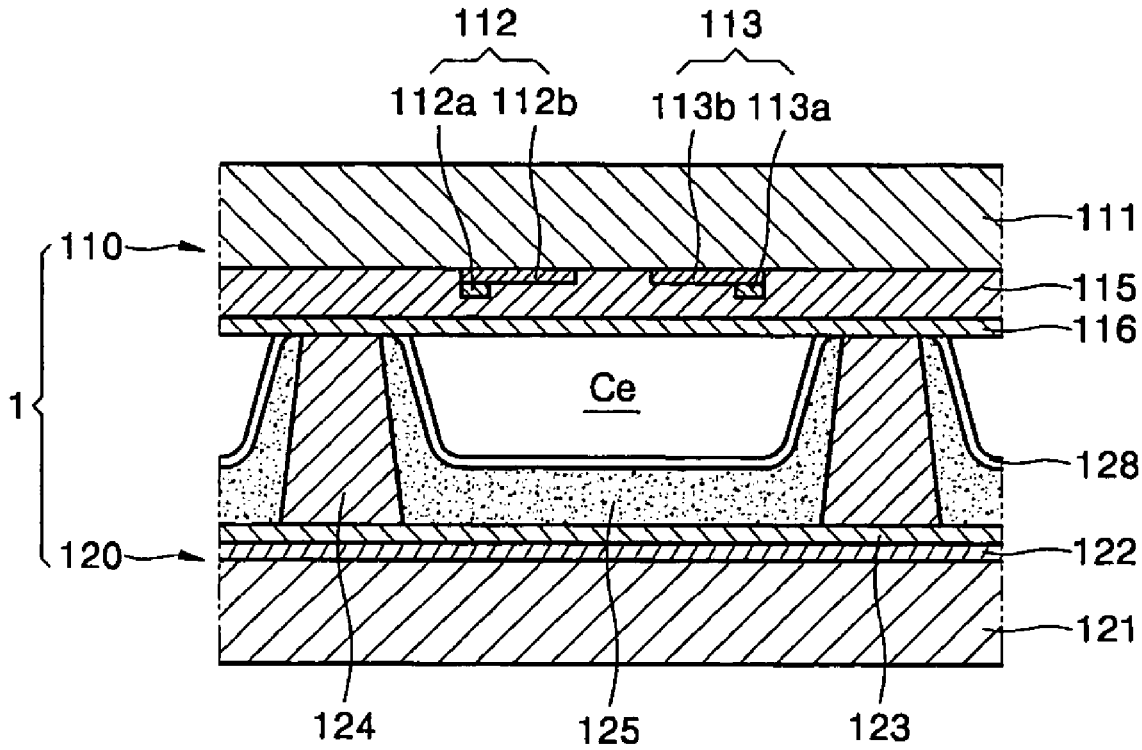
FIG. 2 illustrates a cross-sectional view taken along line II-II of FIG. 1.

FIG. 1 illustrates an exploded perspective view of a plasma display panel to which a driving method according to the present invention is applied. FIG. 2 illustrates a cross-sectional view taken along line II-II of FIG. 1.

As shown in FIG. 1, a plasma display panel 1 may include a front panel 110 and a rear panel 120. The front panel 110 may have a front substrate 111 and the rear panel 120 may have a rear substrate 121. The plasma display panel 1 may include barrier ribs 124 between the front substrate 111 and the rear substrate 121. The barrier ribs 124 may define discharge cells Ce for generating discharge and displaying an image.

The front panel 110 may include a front dielectric layer 115 on the rear surface of the front substrate 111 to cover scan electrode lines 112 and sustain electrode lines 113. The scan electrode lines 112 and the sustain electrode lines 113 may have bus electrodes 112*a* and 113*a* made of highly electrically conductive material, e.g., a metal, for enhancing conductivity and transparent electrodes 112*b* and 113*b* made of a transparent conductive material, e.g., ITO (Indium Tin Oxide), respectively. The scan electrode lines 112 and the sustain electrode lines 113 extend in a same direction as the discharge cells Ce. A front protective layer 116 for protecting the front dielectric layer 115 may be provided on the front dielectric layer 115.

The rear panel 120 may include a rear substrate 121 and a rear dielectric layer 123 formed on the rear substrate 121. Address electrode lines 122 may be disposed in the rear dielectric layer 123 and extend in a direction perpendicular to the direction in which the scan electrode lines 112 and the sustain electrode lines 113 extend.

In the rear panel 120, barrier ribs 124 defining the discharge cells Ce may be provided on the rear dielectric layer 123 and fluorescent layers 125 may be disposed in spaces defined by the barrier ribs 124. In order to protect the fluorescent layers 125, rear protective layers 128 may be provided on the surfaces of the fluorescent layers 125.

The front panel 110 and the rear panel 120 may be bonded to each other and enclosed by a bonding member, e.g., a frit (not shown), but are not necessarily bonded by a bonding member. When the discharge cells Ce are under a vacuum, the front panel 110 and the rear panel 120 may be bonded to each other with the pressure resulting from the vacuum. The discharge cells Ce may be filled with a discharge gas including xenon (Xe), neon (Ne), helium (He), and argon (Ar), or a mixture thereof, where the discharge gas contains approximately 10% xenon (Xe) gas.

The front substrate 111 and the rear substrate 121 may be made of glass. The front substrate 111 may be made of a material having high transmittance. Since the rear substrate 121 does not need to transmit light, the rear substrate 121 may be selected from a range of materials wider than those available for the front substrate 111 and is not limited to the material having high transmittance. A variety of materials having high reflectance or reducing ineffective power may be more desirable.

In order to enhance brightness of the plasma display panel 1, a reflecting layer (not shown) may be formed on the front substrate 121 or on the rear dielectric layer 123, or a reflective material may be included in the rear dielectric layer 123, thereby allowing visible light emitted from the fluorescent material to be effectively reflected toward the front side.

Since the transparent electrodes 112*b* and 113*b* of the scan electrode lines 112 and the sustain electrode lines 113 are disposed on the surface of the front substrate 111, they must be able to transmit the visible light emitted from the fluorescent layers 125. The transparent electrodes 112*b* and 113*b* having excellent transmittance may be made of ITO, $SnO_2$, or ZnO. Since the address electrode lines 122 can be formed without considering transmittance, the address electrode lines 122 may be formed of a wide selection of materials and may be made of highly conductive materials, e.g., Ag, Cu, Cr. A front protective layer 116 may be formed on the front dielectric layer 115. The front protective layer 116 serves to protect the front dielectric layer 115 and to emit secondary electrons to promote the discharge.

The barrier ribs 124 disposed between the front substrate 111 and the rear substrate 121 may be formed to define the discharge cells Ce in conjunction with the front substrate 111 and the rear substrate 121. FIG. 1 shows that the barrier ribs 124 partition the discharge cells Ce in a matrix. However, the discharge cells Ce are not limited to the matrix, but may be partitioned in a variety of patterns, e.g., a beehive pattern and a delta pattern. Further, while FIG. 2 illustrates that the cross-sections of the discharge cells Ce are rectangular, the shape of the discharge cells if not limited to being rectangular. For example, the discharge cells Ce may have a cross-section of a polygonal shape, e.g., a triangle, a pentagon, a circle or an ellipse.

The barrier ribs 124 may be formed on the rear dielectric layer 123 and may be made of glass including elements such as Pb, B, Si, Al, and O. Fillers such as $ZrO_2$, $TiO_2$, and $Al_2O_3$ and pigments such as Cr, Cu, Co, Fe, and $TiO_2$ may be added thereto as needed. The barrier ribs 124 may secure spaces in which the fluorescent layers 125 can be coated, resist a pressure, which results from the degree of vacuum (for example, 0.5 atm) of the discharge gas filled between the front panel 110 and the rear panel 120, and prevent crosstalk between the discharge cells Ce. Red, green, and blue fluorescent layers 125 may be disposed in the spaces defined by the barrier ribs 124, and the fluorescent layers 125 may be partitioned by the barrier ribs 124.

The fluorescent layers 125 may be formed by applying fluorescent paste to the surface of the rear dielectric layer 123 and the barrier ribs 124 and performing a dry process and a baking process thereto, where one fluorescent material of a red fluorescent material, a green fluorescent material, and a blue fluorescent material, a solvent, and a binder are mixed to form the fluorescent paste. An example of the red fluorescent material includes $Y(V,P)O_4$:Eu, examples of the green fluorescent material includes $ZnSiO_4$:Mn and $YBO_3$:Tb, and an example of the blue fluorescent material includes BAM:Eu.

A rear protective layer 128, e.g., MgO, may be formed on the entire surface of each fluorescent layer 125. The rear protective layer 128 prevents deterioration of the fluorescent layer due to collision with discharge particles when discharge occurs in the discharge cell Ce, and emits secondary electrons so as to promote the discharge.

Figure 3:
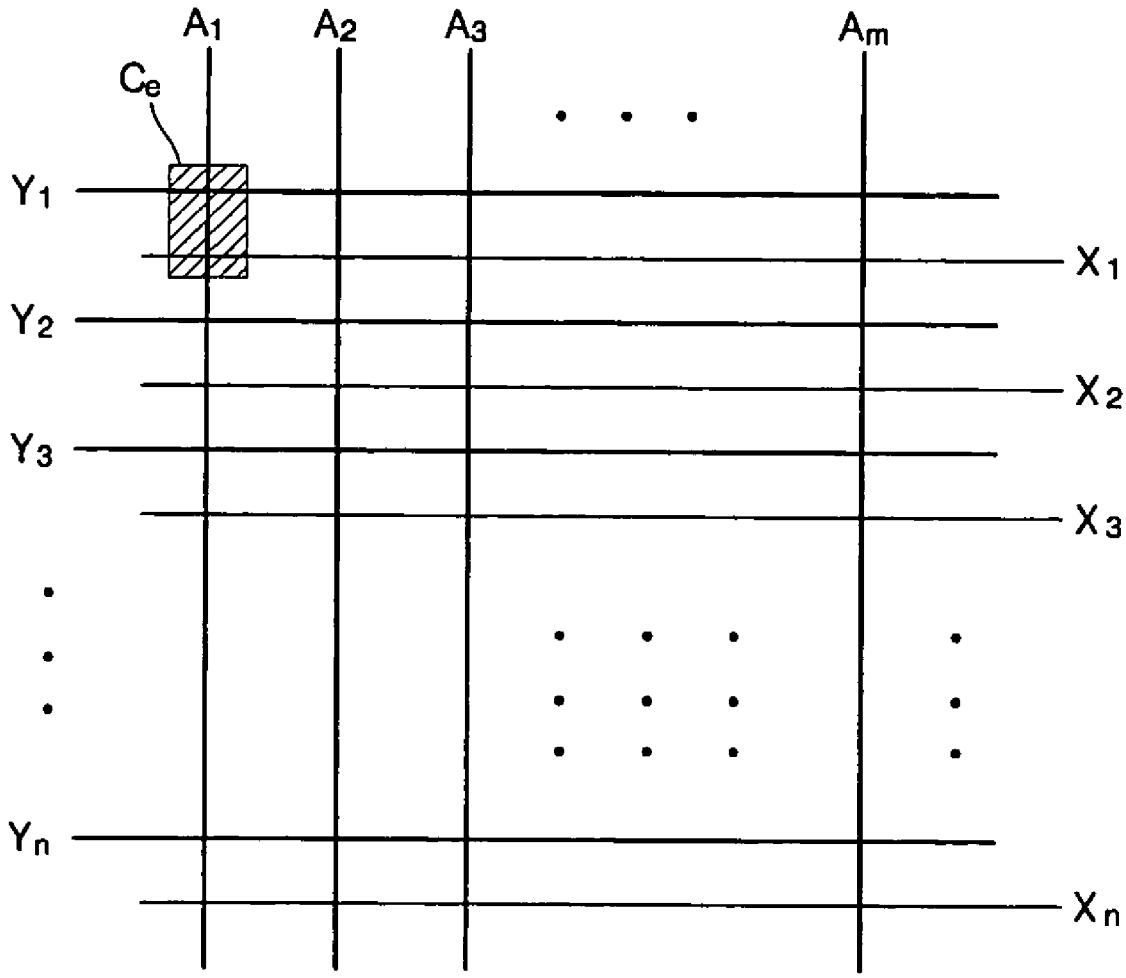
FIG. 3 illustrates a diagram schematically illustrating the arrangement of electrodes in the plasma display panel shown in FIG. 1.

FIG. 3 illustrates a schematic diagram of the arrangement of electrodes in the plasma display panel shown FIG. 1.

Referring to FIGS. 1 to 3, the scan electrode lines Y1, Y2, . . . , Yn and the sustain electrode lines X1, X2, . . . , Xn may be arranged to be parallel to each other. That is, the scan electrode lines Y1, Y2, . . . , Yn and the sustain electrode lines X1, X2, . . . , Xn may be arranged in the front dielectric layer 115. The address electrode lines A1, A2, . . . , Am may be arranged to be perpendicular to the scan electrode lines Y1, Y2, . . . , Yn and the sustain electrode lines X1, X2, . . . , Xn. The discharge cells Ce may be defined in the areas where the scan electrode lines Y1, Y2, . . . , Yn and the sustain electrode lines X1, X2, . . . , Xn intersect the address electrode lines A1, A2, . . . , Am.

Figure 4:
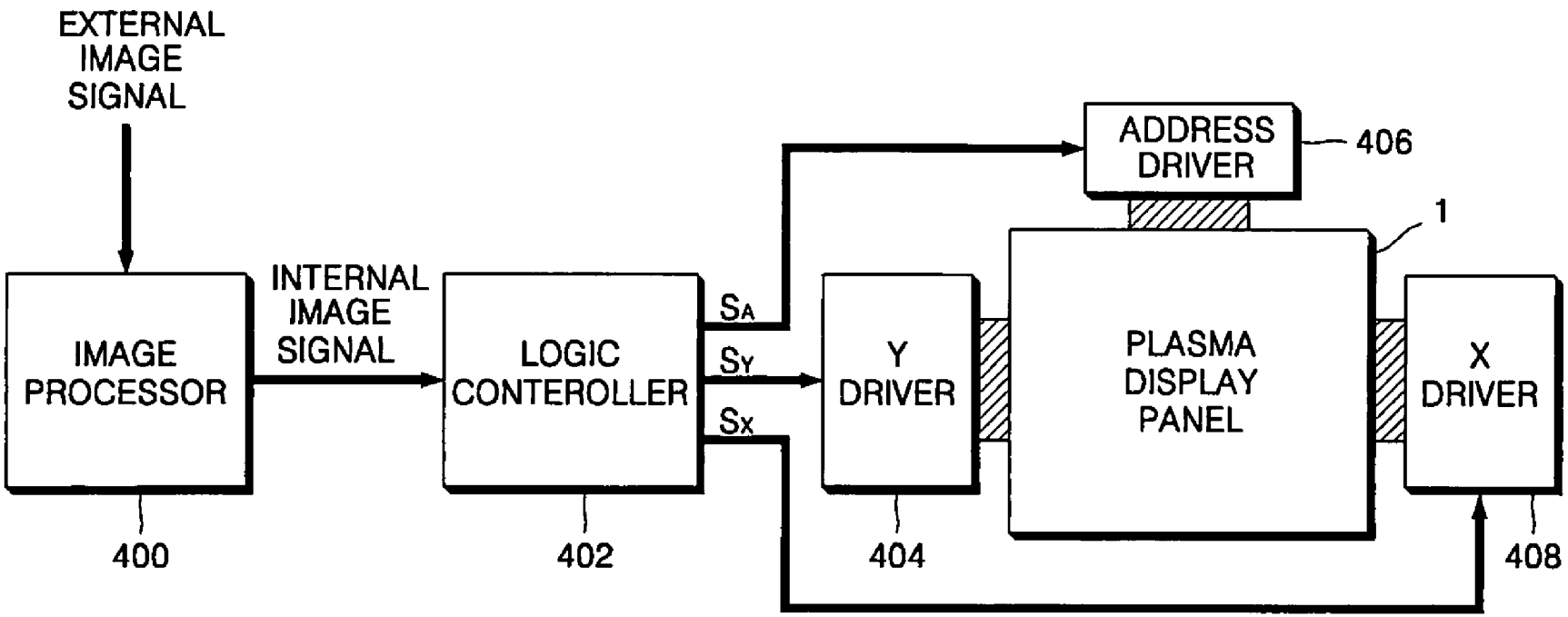
FIG. 4 illustrates a block diagram of a driving device embodying the driving method of the plasma display panel shown in FIG. 1.

FIG. 4 illustrates a block diagram of a driving device embodying the driving method of the plasma display panel shown in FIG. 1. Referring to FIGS. 3 and 4, the driving device of the plasma display may include an image processor 400, a logic controller 402, a Y driver 404, an address driver 406, an X driver 408 and the plasma display panel 1.

The image processor 400 receives external image signals, e.g., PC signals, DVD signals, video signals, and TV signals, converts analog signals into digital signals, processes the digital signals and outputs the processed digital signals as internal image signals. The internal image signals may include red (R), green (G), and blue (B) image data, clock signals, and vertical and horizontal synchronization signals having 8 bits, respectively.

The logic controller 402 receives the internal image signals from the image processor 400, performs a gamma correction, an automatic power control, etc., and outputs an address driving control signal $S_A$, an Y driving control signal $S_Y$, and an X driving control signal $S_X$. The logic controller 402 of the present invention detects an average signal level (ASL) from the internal image signals every unit frame. When the average signal level is less than a predetermined value, the logic controller 402 outputs the driving control signals $S_X$ and $S_Y$ to generate overlapping sustain pulses. When the average signal level is equal to or greater than the predetermined value, the logic controller 402 outputs the driving control signals $S_X$ and $S_Y$ to generate non-overlapping sustain pulses.

The Y driver 404 receives the Y driving control signal $S_Y$ from the logic controller 402 and applies erasing pulses having an erasing voltage for initializing discharge during a reset period (PR in FIG. 6), scanning signals having a positive scan-high voltage ($V_{sch}$ in FIG. 6) and a negative scan-low voltage ($V_{scl}$ in FIG. 6) to which the positive scan-high voltage is sequentially changed during an address period (PA in FIG. 6), sustain pulses having a positive sustain discharge voltage ($V_s$ in FIG. 6) and a ground voltage ($V_g$ in FIG. 6) during a sustain period (PS in FIG. 6), to the scan electrode lines Y1, Y2, . . . , Yn of the plasma display panel 1, respectively.

The address driver 406 receives the address driving control signal $S_A$ from the logic controller 402 and outputs display data signals to the address electrode lines of the plasma display panel 1 during the address period (PA in FIG. 6), where the display data signals apply an address voltage ($V_a$ in FIG. 6) to selected cells. The address driver 406 applies short pulses during the sustain period (PS in FIG. 6). The voltage of the short pulse may be less than or equal to the address voltage ($V_a$ in FIG. 6).

The X driver 408 receives the X driving control signal ($S_X$) from the logic controller 402 and applies the sustain pulses, which have a bias voltage ($V_b$ in FIG. 6) during the reset period PR and the address period PA and the positive sustain discharge voltage Vs and the ground voltage $V_g$ during the sustain period, to the sustain electrode lines X1, X2, . . . , Xn of the plasma display panel 1.

Figure 5:
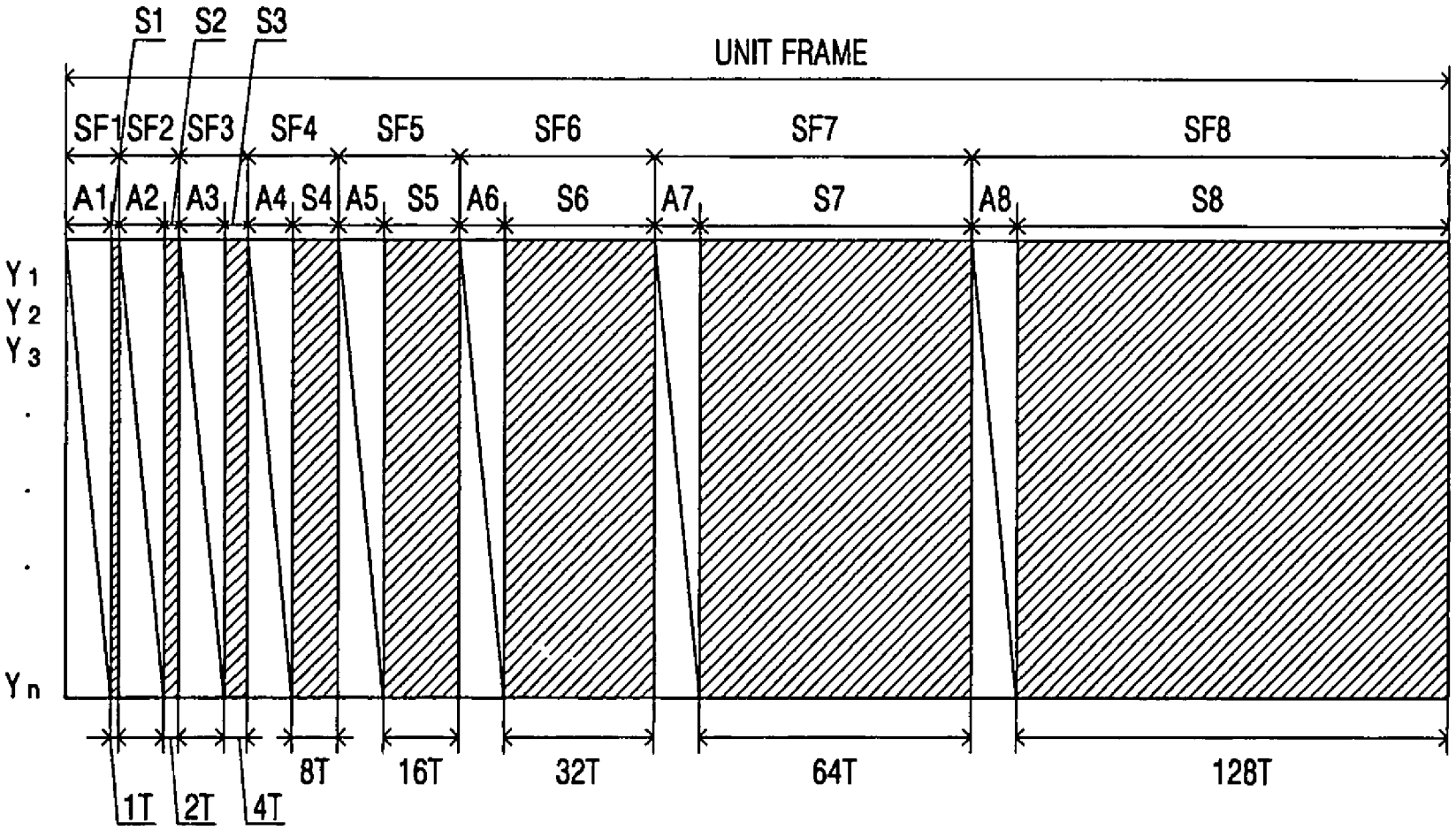
FIG. 5 illustrates an address-display separation driving method of scan electrode lines as an example of the driving method of the plasma display panel shown in FIG. 1.

FIG. 5 illustrates an address-display separation driving method of the scan electrode lines as an example of the driving method of the plasma display panel shown in FIG. 1.

Referring to FIGS. 3 and 5, a unit frame may be divided into a plurality of subfields, e.g., eight subfields SF1, . . . , SF8, to display gray scales in a time-sharing system. Each subfield SF1, . . . , SF8 may be divided into a reset period (not shown), an address period A1, . . . , A8, and a sustain period S1, . . . , S8.

During each address period A1, . . . , A8, the display data signals may be applied to the address electrode lines A1, A2, . . . , Am and the corresponding scanning pulses may be sequentially applied to the scan electrode lines Y1, Y2, . . . , Yn.

During each sustain period S1, . . . , S8, the sustain pulses may be alternately applied to the scan electrode lines Y1, Y2, . . . , Yn and the sustain electrode lines X1, X2, . . . , Xn. Thus, the discharge cells in which wall charges are formed during the address period A1, . . . , A8 generate sustain discharge.

Brightness of the plasma display panel is proportional to the number of sustain pulses in a unit frame. When one frame constituting one image is expressed with eight subfields and 256 gray scales, different numbers of sustain pulses can be allocated to the subfields at ratios of 1, 2, 4, 8, 16, 32, 64 and 128. If 133 gray scales are to be displayed, the cells can be addressed and generate the sustain discharge in SF1, SF3 and SF8.

The numbers of sustain pulses allocated to the subfields can be variably determined depending upon weighting values of the subfields according to the automatic power control. The numbers of sustain pulses allocated to the subfields can be variously changed by taking a gamma characteristic or a panel characteristic into consideration. For example, the degree of gray scale allocated to SF4 can be decreased from 8 to 6, and the degree of gray scale allocated to SF6 can be increased from 32 to 34. The number of subfields constituting one frame can be changed variously in accordance with a design specification.

Figure 6:
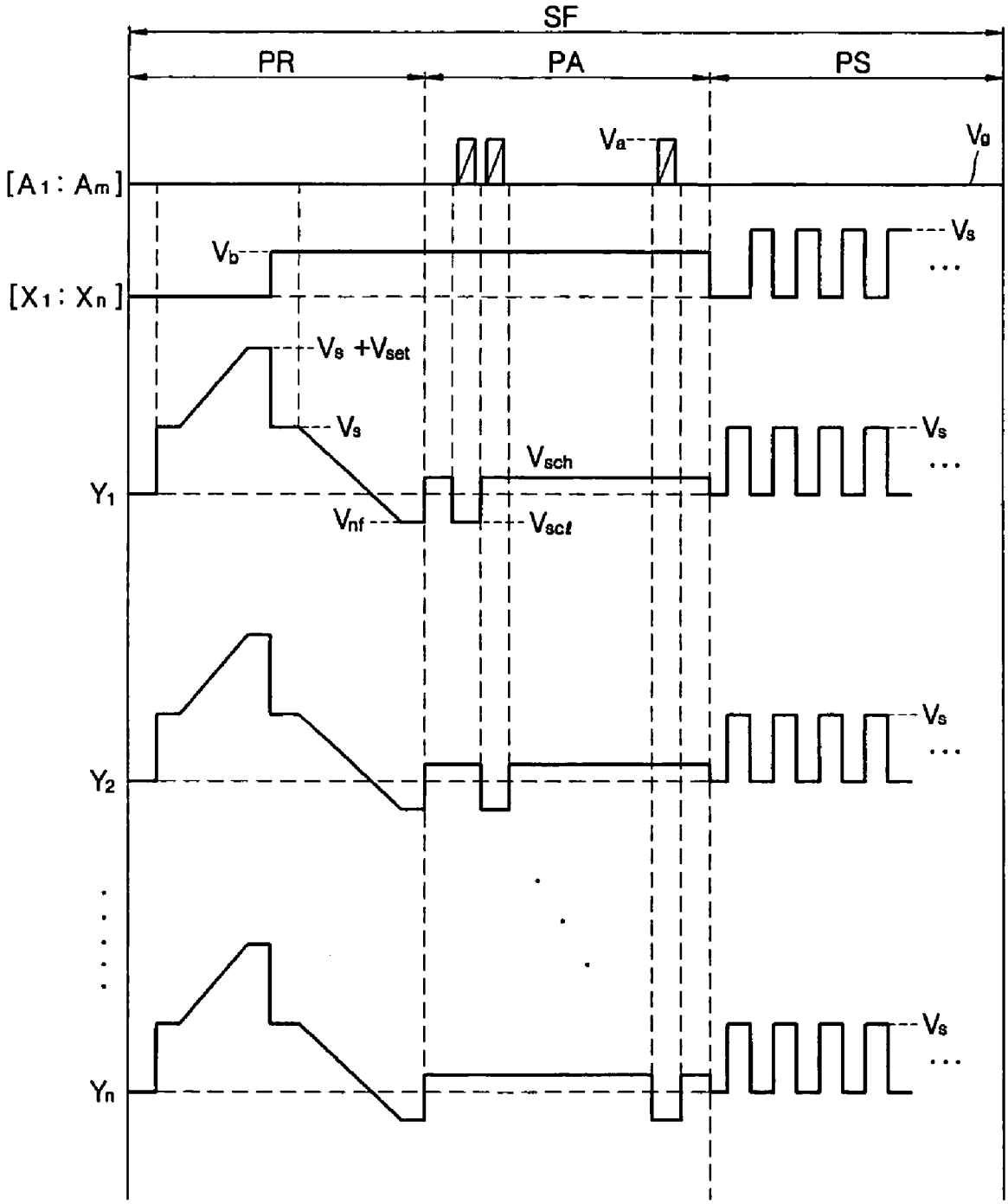
FIG. 6 illustrates a timing chart of driving signals for driving the plasma display panel shown in FIG. 1.
Figure 7:
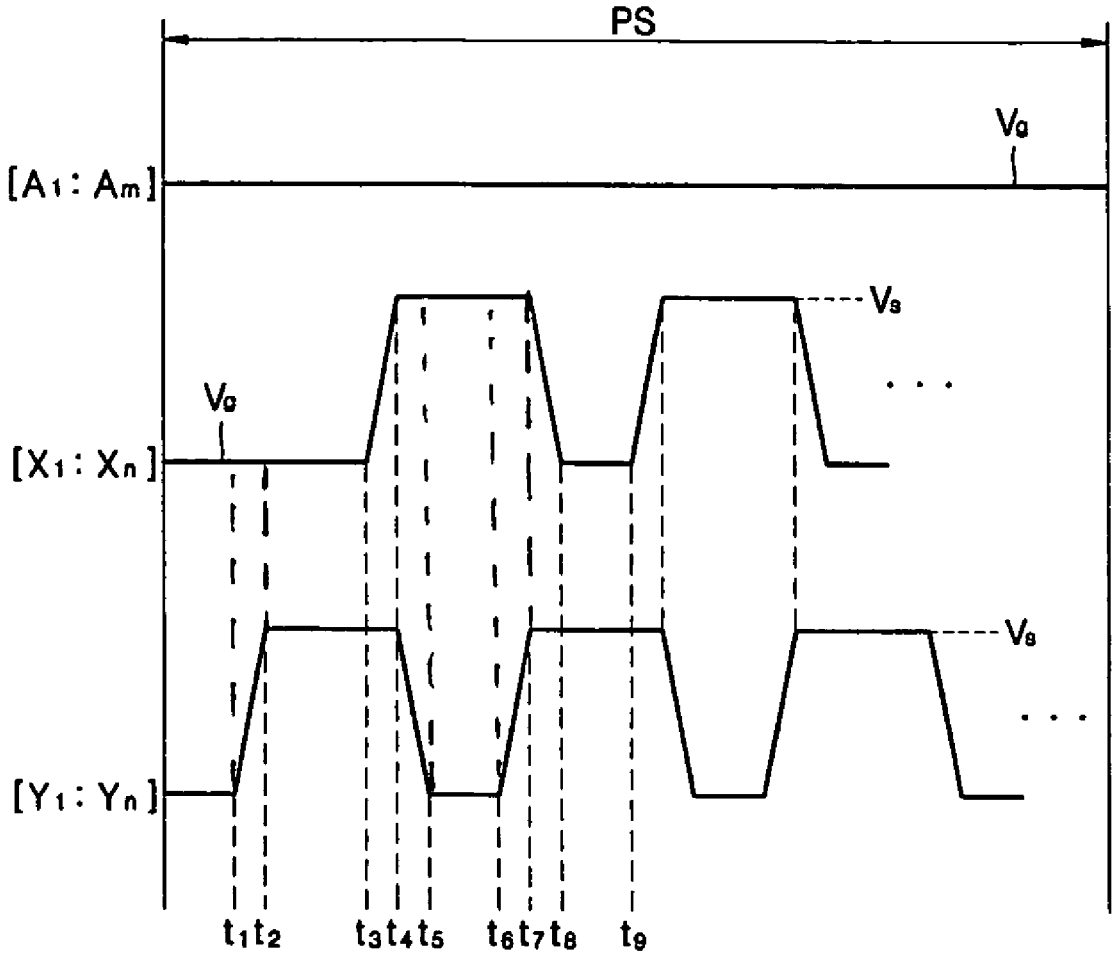
FIG. 7 illustrates a detailed timing chart of overlapping sustain pulses during a sustain period of FIG. 6.
Figure 8:
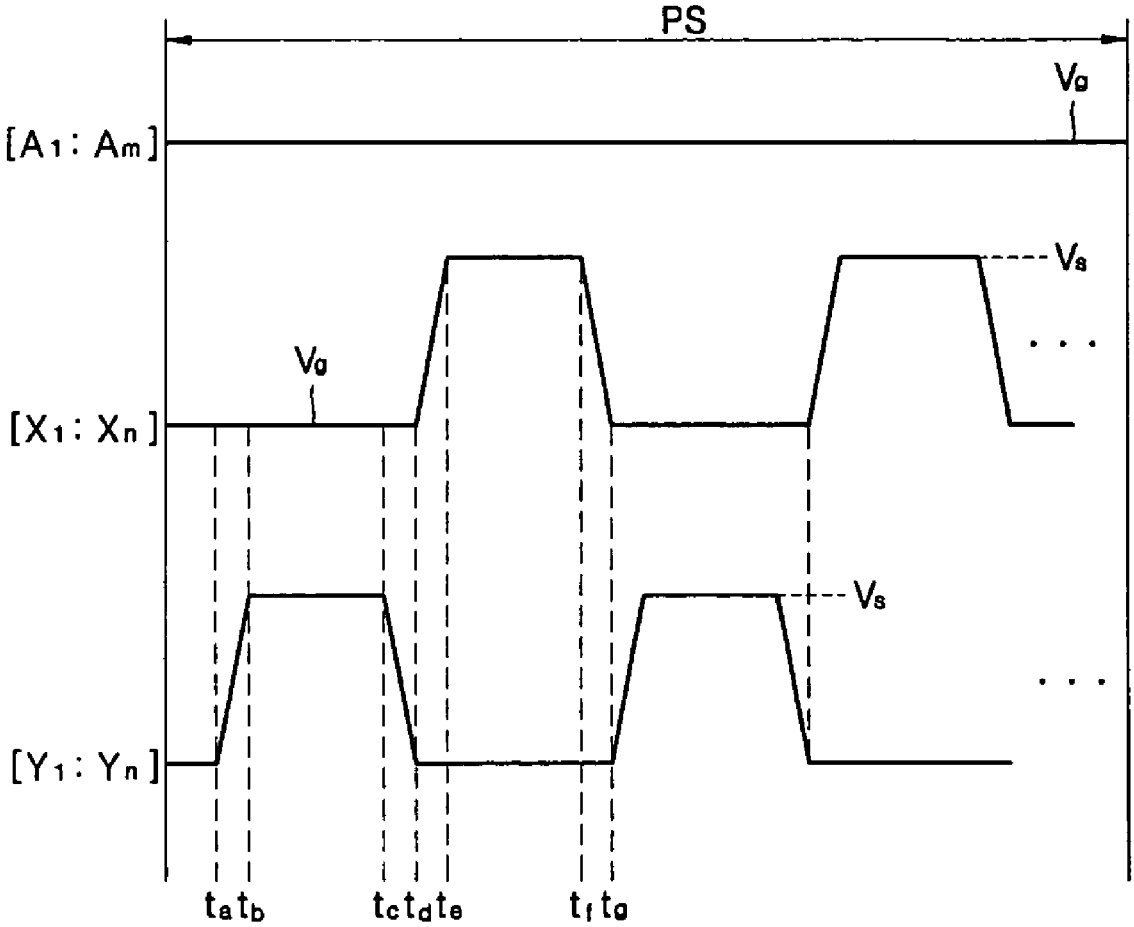
FIG. 8 illustrates a detailed timing chart of non-overlapping sustain pulses during the sustain period of FIG. 6.

FIG. 6 illustrates a timing chart of driving signals for driving the plasma display panel shown in FIG. 1. FIG. 7 illustrates a detailed timing chart of overlapping sustain pulses during the sustain period of FIG. 6. FIG. 8 illustrates a detailed timing chart of non-overlapping sustain pulses during the sustain period of FIG. 6.

As noted above, a subfield SF has a reset period PR, an address period PA, and a sustain period PS.

During the reset period PR, a ground voltage $V_g$ may be first applied to the scan electrode lines Y1, Y2, . . . , Yn. Next, the sustain discharge voltage $V_s$ may be abruptly applied the scan electrode lines Y1, Y2, . . . , Yn, and then a rising ramp signal having a rising voltage $V_{set}$ may be applied to reach the maximum voltage $V_{set}+V_s$. Weak discharge is generated because the rising ramp signal having a non-abrupt slope is applied. Negative charges are accumulated in the vicinity of the scan electrode lines Y1, Y2, . . . , Yn due to the weak discharge. Next, the scan electrode lines the scan electrode lines Y1, Y2, . . . , Yn abruptly falls to the sustain discharge voltage Vs. Then, a falling ramp signal is applied thereto to reach the lowest falling voltage $V_{nf}$. Weak discharge is generated because the falling ramp signal having a non-abrupt slope is applied to the scan electrode lines. The negative charges accumulated in the vicinity of the scan electrode lines Y1, Y2, . . . , Yn are partially emitted due to the weak discharge. As a result, an amount of negative charges suitable for generating address discharge remains in the vicinity of the scan electrode lines Y1, Y2, . . . , Yn. At the time of applying the falling ramp signal to the scan electrode lines Y1, Y2, . . . , Yn, a bias voltage $V_b$ may be applied to the sustain electrode lines X1, X2, . . . , Xn. During the reset period PR, the ground voltage $V_g$ may be applied to the address electrode lines A1, A2, . . . , Am.

Next, during the address period PA, in order to select the cells to display an image, a scan high voltage $V_{sch}$ may be applied to the scan electrode lines Y1, Y2, . . . , Yn and then a scanning pulse having a scan low voltage $V_{scl}$ may be sequentially applied to the scan electrode lines. A display data signal having an address voltage $V_a$ may be applied to the address electrode lines A1, A2, . . . , Am in accordance with the scanning pulse. The bias voltage $V_b$ may be continuously applied to the sustain electrode lines X1, X2, . . . , Xn. The address discharge may be carried out by the address voltage Va, the scan low voltage $V_{scl}$, a wall voltage due to negative charges in the vicinity of the scan electrodes Y and a wall voltage due to positive charges in the vicinity of the address electrodes A. After the address discharge is carried out, positive charges are accumulated in the vicinity of the scan electrodes Y and negative electrodes are accumulated in the vicinity of the sustain electrodes X.

During the sustain period PS, the logic controller 402 shown in FIG. 4 detects an average signal level every unit frame. When the average signal level is less than a predetermined value, a first sustain pulse and a second sustain pulse which reach the sustain discharge voltage $V_s$ with a rising slope and reach the ground voltage $V_g$ with a falling slope are alternately applied to the scan electrode lines Y1, Y2, . . . , Yn and the sustain electrode lines X1, X2, . . . , Xn, respectively. Intervals having the sustain discharge voltage $V_s$ in the first sustain pulse and the second sustain pulse temporally overlap with each other. Such first sustain pulse and second sustain pulse are referred to as overlapping sustain pulses.

The overlapping sustain pulses are described in detail with reference to FIG. 7. From $t_1$ to $t_2$, the first sustain pulse applied to the scan electrode lines Y1, Y2, . . . , Yn may reach the sustain discharge voltage $V_s$ with a rising slope. At this time, the second sustain pulse applied to the sustain electrode lines X1, X2, . . . , Xn may have the ground voltage $V_g$. From $t_2$ to $t_4$, the first sustain pulse may continuously have the sustain discharge voltage $V_s$. From $t_2$ to $t_3$, the second sustain pulse may continuously have the ground voltage $V_g$, and may reach the sustain discharge voltage $V_s$ with a rising slope from $t_3$ to $t_4$. As a result, at $t_4$, the first sustain pulse and the second sustain pulse have the sustain discharge voltage $V_s$ temporally overlapping with each other. Next, from $t_4$ to $t_5$, the first sustain pulse may reach the ground voltage $V_g$ with a falling slope. From $t_4$ to $t_7$, the second sustain pulse may have the first voltage $V_s$. From $t_5$ to $t_6$, the first sustain pulse may have the ground voltage $V_g$. From $t_6$ to $t_7$, the first sustain pulse may reach the first voltage $V_s$ with a rising slope. The second sustain pulse reaches the ground voltage $V_g$ with a falling slope from $t_7$ to $t_8$, and may have the ground voltage $V_g$ from $t_8$ to $t_9$. The rising slope and the falling slope are usually used for energy charging and recovery.

The overlapping waveform during the sustain period PS means that intervals having the sustain discharge voltage $V_s$ in the first sustain pulse applied to the scan electrodes Y and the second sustain pulse applied to the sustain electrodes X overlap. The present invention is not limited to the case where the first voltage overlaps at $t_4$, i.e., the first voltage may overlap the second voltage for a longer time period. The longer the overlapping interval is, the shorter the periods of the first sustain pulse and the second sustain pulse can be and the shorter an interval between the sustain pulses can be. That is, when the discharge frequency is increased, space charges can be more utilized in the sustain discharge. Therefore, the discharge efficiency of the overlapping sustain pulses is better than that of the non-overlapping sustain pulses.

The sustain discharge is described from the viewpoint of wall charges. When the first sustain pulse has the sustain discharge voltage $V_s$, the sustain discharge is carried out by the sustain discharge voltage $V_s$ of a positive polarity applied to the scan electrodes Y, the ground voltage $V_g$ applied to the sustain electrodes X, a wall voltage due to the positive charges accumulated in the vicinity of the scan electrodes Y and a wall voltage due to the negative charges accumulated in the vicinity of the sustain electrodes X. In the meantime, negative charges are accumulated in the vicinity of the scan electrodes Y and positive charges are accumulated in the vicinity of the sustain electrodes X.

Next, when the second sustain pulse has the sustain discharge voltage $V_s$, the sustain discharge is carried out by the sustain discharge voltage $V_s$ of a positive polarity applied to the sustain electrodes X, the ground voltage $V_g$ applied to the scan electrodes Y, a wall voltage due to the positive charges accumulated in the vicinity of the sustain electrodes X and a wall voltage due to the negative charges accumulated in the vicinity of the scan electrodes Y. In the meantime, positive charges are accumulated in the vicinity of the scan electrodes Y and negative charges are accumulated in the vicinity of the sustain electrodes X. These operations may be successively repeated, thus successively performing the sustain discharge.

When the average signal level detected by the logic controller 402 shown in FIG. 4 is greater than or equal to the predetermined value, the first sustain pulse and the second sustain pulse, which reach the sustain discharge voltage $V_s$ with a rising slope and reach the ground voltage $V_g$ with a falling slope, are alternately applied to the scan electrode lines Y1, Y2, . . . , Yn and the sustain electrode lines X1, X2, . . . , Xn, respectively. The intervals having the sustain discharge voltage $V_s$ in the first sustain pulse and the second sustain pulse do not temporally overlap with each other. Such first and second sustain pulses are referred to as non-overlapping sustain pulses.

The non-overlapping sustain pulses are described in detail with reference to FIG. 8. From $t_a$ to $t_b$, the first sustain pulse applied to the scan electrode lines Y1, Y2, . . . , Yn may reach the sustain discharge voltage $V_s$ with a rising slope, and the second sustain pulse applied to the sustain electrode lines X1, X2, . . . , Xn may have the ground voltage $V_g$. From $t_b$ to $t_c$, the first sustain pulse may have the sustain discharge voltage Vs and the second sustain pulse may have the ground voltage $V_g$. From $t_c$ to $t_d$, the first sustain pulse may reach the ground voltage $V_g$ with a falling slope, and the second sustain pulse may have the ground voltage $V_g$. From $t_d$ to $t_e$, the first sustain pulse may have the ground voltage $V_g$ and the second sustain pulse may reach the first voltage $V_s$ with a rising slope. From $t_e$ to $t_f$, the first sustain pulse may have the ground voltage $V_g$ and the second sustain pulse has the first voltage $V_s$. From $t_f$ to $t_g$, the first sustain pulse may have the ground voltage $V_g$ and the second sustain pulse may reach the ground voltage $V_g$ with a falling slope. The first sustain pulse and the second sustain pulse may be applied to the scan electrode lines Y1, Y2, . . . , Yn and the sustain electrode lines X1, X2, . . . , Xn by repeating the above-mentioned operations. The rising slope and the falling slope are usually used for energy charging and recovery.

When the non-overlapping sustain pulses are applied, the period of the sustain discharge is increased and the frequency of the sustain discharge is decreased. Therefore, the discharge efficiency of the non-overlapping sustain pulses is less than that of the overlapping sustain pulses. However, when there are a large number of sustain pulses, use of overlapping sustain pulses may result in increased temperatures and decreased lifetimes.

As described above, the present invention provides the following advantages.

In the present invention, the average signal level (ASL) is detected every unit frame. When the average signal level is less than a predetermined value, the number of sustain pulses is small. Therefore, the overlapping sustain pulses do not significantly raise the temperature, but do enhance the discharge efficiency and the brightness. In contrast, when the average signal level is greater than or equal to the predetermined value, the number of sustain pulses is increased. Therefore, the non-overlapping sustain pulses can suppress an increase in temperature and extend the lifetime of the plasma display panel.

Therefore, according to the present invention, the discharge efficiency is enhanced, the increase in temperature can be suppressed, and the panel lifetime can be extended.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A driving method of a plasma display panel in which scan electrode lines and sustain electrode lines are parallel to each other and address electrode lines are spaced from and intersect the scan electrode lines and the sustain electrode lines, the method comprising:

temporally dividing a unit frame into a plurality of subfields;

generating a driving signal having a reset period, an address period, and a sustain period for each subfield;

detecting an average signal level for the unit frame;

alternately applying a first sustain pulse to the scan electrode lines and a second sustain pulse to the sustain electrode lines, wherein each of the first sustain pulse and the second sustain pulse reaches a first voltage with a rising slope and reaches a second voltage, lower than the first voltage, with a falling slope; and controlling a timing of alternately applying in accordance with the average signal level for the unit frame, wherein, when the average signal level is less than a predetermined value, controlling the timing includes having the first voltage in the first sustain pulse and in the second sustain pulse simultaneously.

2. The driving method as claimed in claim 1, wherein when the average signal level is equal to or more than the predetermined value, controlling the timing includes having the first voltage in the first sustain pulse and in the second sustain pulse distinctly.

3. The driving method as claimed in claim 1, further comprising, during the reset period:

applying a sustain discharge voltage to the scan electrode lines;

applying a rising voltage to the scan electrode lines;

applying a falling ramp signal to the scan electrode lines to reach a lowest falling voltage; and applying a bias voltage to the sustain electrode lines during applying the falling ramp signal.

4. The driving method as claimed in claim 3, wherein applying the falling ramp signal includes abruptly falling to the sustain discharge voltage and then gradually falling from the sustain discharge voltage to the lowest falling voltage.

5. The driving method as claimed in claim 4, further comprising delaying gradually falling after abruptly falling.

6. The driving method as claimed in claim 3, wherein applying the sustain discharge voltage includes abruptly applying the sustain discharge voltage to the scan electrode lines and applying the rising voltage includes gradually applying the rising voltage to the scan electrode lines.

7. The driving method as claimed in claim 6, further comprising delaying gradually applying the rising voltage after abruptly applying the sustain discharge voltage.

8. The driving method as claimed in claim 3, further comprising, during the address period:

sequentially applying a scan high voltage to the scan electrode lines and then applying a scan low voltage; and applying an address voltage to the address electrode lines of selected cells.

9. The driving method as claimed in claim 8, further comprising applying the bias voltage to the sustain electrode lines during the address period.

10. The driving method as claimed in claim 8, wherein the scan low voltage equals the lowest falling voltage.

11. The driving method as claimed in claim 1, further comprising, during the address period:

sequentially applying a scan high voltage to the scan electrode lines and then applying a scan low voltage; and applying an address voltage to the address electrode lines of selected cells.

12. The driving method as claimed in claim 11, further comprising applying a bias voltage to the sustain electrode lines.

13. A driving method of a plasma display panel in which scan electrode lines and sustain electrode lines are parallel to each other and address electrode lines are spaced from and intersect the scan electrode lines and the sustain electrode lines, the method comprising:

temporally dividing a unit frame into a plurality of subfields;

generating a driving signal having a reset period, an address period, and a sustain period for each subfield;

detecting an average signal level for the unit frame;

alternately applying a first sustain pulse to the scan electrode lines and a second sustain pulse to the sustain electrode lines, wherein each of the first sustain pulse and the second sustain pulse reaches a first voltage with a rising slope and reaches a second voltage, lower than the first voltage, with a falling slope; and varying a timing of alternately applying the first sustain pulse relative to the second sustain pulse in accordance with the average signal level for the unit frame.

14. The driving method as claimed in claim 13, wherein varying includes:

applying overlapping first and second sustain pulses when the average signal level is less than a predetermined value; and applying non-overlapping first and second sustain pulses when the average signal level is greater than or equal to the predetermined value.

15. The driving method as claimed in claim 13, wherein varying includes:

alternately applying first and second sustain pulses in accordance with a first timing when the average signal level is less than a predetermined value; and alternately applying first and second sustain pulses in accordance with a second timing when the average signal level is greater than or equal to the predetermined value, the second timing being different from the first timing.

16. The driving method as claimed in claim 15, wherein the first timing applies first and second sustain pulses at a higher frequency than the second timing.

17. The driving method as claimed in claim 16, wherein at least one of the first timing and the second timing apply the first voltage for a different length of time than the second voltage.

18. The driving method as claimed in claim 17, wherein the first and second timings apply the first voltage for a same period of time.

19. The driving method as claimed in claim 15, wherein at least one of the first timing and the second timing apply the first voltage for a different length of time than the second voltage.

20. The driving method as claimed in claim 15, wherein the first and second timings apply the first voltage for a same period of time.

* * * * *